US006186069B1

(12) United States Patent
Dippenaar

(10) Patent No.: US 6,186,069 B1
(45) Date of Patent: Feb. 13, 2001

(54) EXPLOSIVES BOOSTER

(75) Inventor: Llewellyn Dippenaar, Bronkhorstpruit (ZA)

(73) Assignee: Ensign-Bickford (South Africa Proprietary) Limited, Bronkhorstpruit (ZA)

( * ) Notice: Under 35 U.S.C. 154(b), the term of this patent shall be extended for 0 days.

(21) Appl. No.: 09/288,335

(22) Filed: Apr. 8, 1999

(30) Foreign Application Priority Data

Apr. 9, 1998 (ZA) ..... 98/3035

(51) Int. Cl.[7] ..... F42B 3/00; C06C 5/04
(52) U.S. Cl. ..... 102/318; 102/275.4
(58) Field of Search ..... 102/318, 275.4

(56) References Cited

U.S. PATENT DOCUMENTS 3,238,876 * 3/1966 Allen ..... 102/275.4
3,244,103 * 4/1966 Spickard ..... 102/275.4 X
3,713,384 1/1973 Turnbull ..... 102/27 R
3,880,080 4/1975 Cook ..... 102/24 R
4,331,081 5/1982 Cloutier et al. ..... 102/318
4,383,484 5/1983 Morrey ..... 102/275.3
4,938,143 7/1990 Thomas et al. ..... 102/318
5,714,712 * 2/1998 Ewick et al. ..... 102/275.4 X
5,780,764 * 7/1998 Wetch et al. ..... 102/318

* cited by examiner

*Primary Examiner*—Peter A. Nelson
(74) *Attorney, Agent, or Firm*—Finnegan, Henderson, Farabow, Garrett, & Dunner, L.L.P.

(57) ABSTRACT

An explosives booster (10) intended for igniting a main explosive charge is provided which includes a first explosive charge (15) which is sensitive enough to be ignited by the explosion of a charge from a detonator (13); and a second explosive (16) charge which is less sensitive to ignition that the first charge, (15) but more sensitive to ignition than the main charge. The first charge may comprise a 60/40, and the second charge a 40/60, PETN/TNT pentolite mixture.

9 Claims, 1 Drawing Sheet

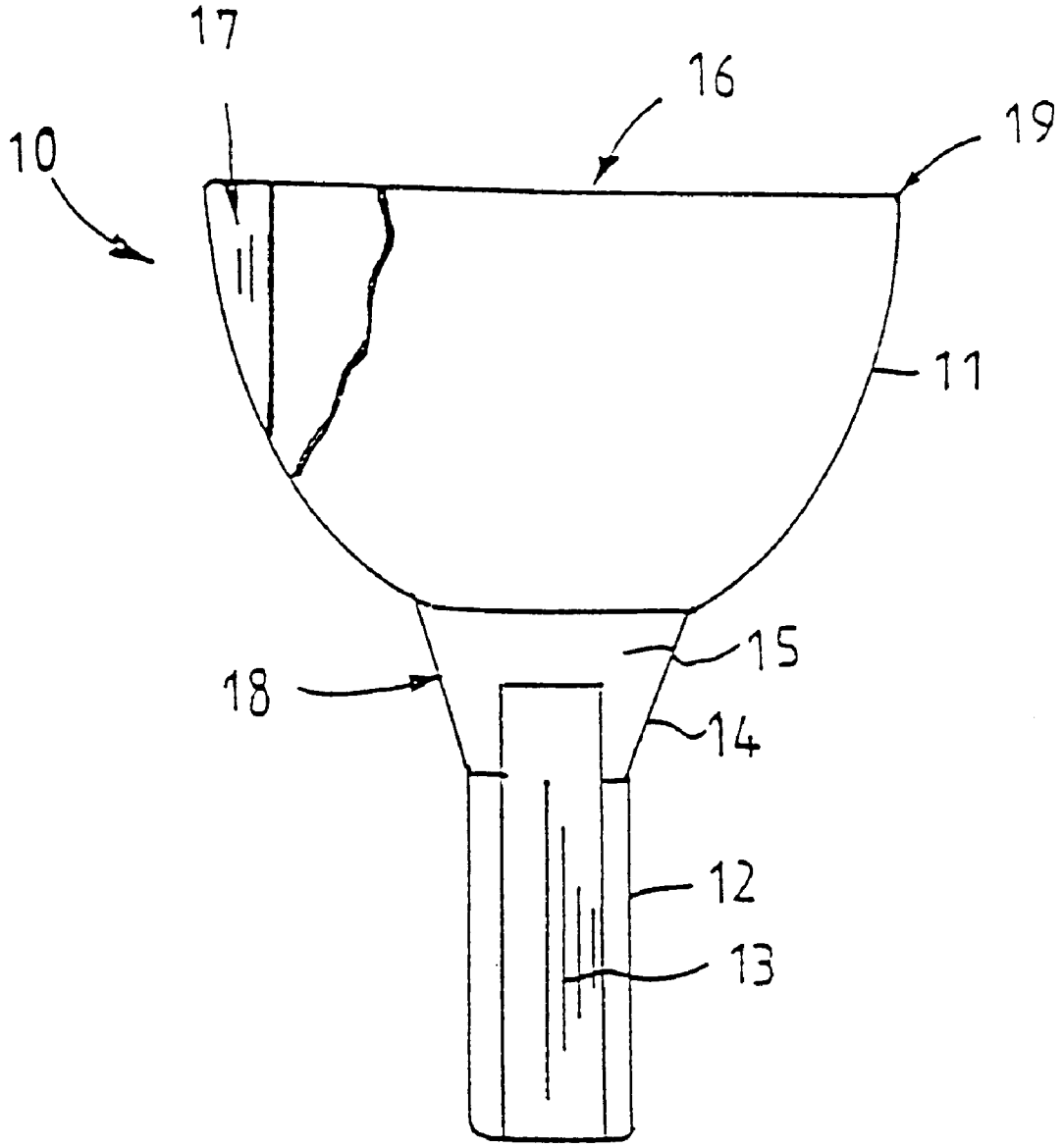
17
16
19
10
11
15
18
14
12
13

EXPLOSIVES BOOSTER

BACKGROUND OF THE INVENTION

This invention relates to an explosives booster.

Explosives boosters are used for amplifying the explosion from a detonator in the direction of the main charge.

PRIOR ART TO THE INVENTION

The known boosters usually comprise an elongated hollow body, usually of cardboard or plastics, which is charged with an explosive material which is more sensitive to detonation than the main charge.

A common material for such booster charge is pentolite, which is a mixture of pentaerythritol tetranitrate ("PETN") and trinitrotolune ("TNT").

It is also known to employ a booster body which is of cone shape, with the arrangement such that the detonator is located towards the base of the cone, and the wider end of the cone faces the main charge.

The known detonator boosters suffer from various disadvantages.

Thus, for example, because of the relatively high concentration of the PETN component of the pentolite mixture, the known boosters are relatively expensive.

Other disadvantages relate to the configuration of the booster body and the dimensional interrelationship of its components, both which may adversely influence the effectiveness of the explosion and the resultant shock wave.

OBJECT OF THE INVENTION

It is accordingly an object of this invention to provide an explosives booster with which the aforesaid disadvantages may be overcome or at least minimised.

SUMMARY OF THE INVENTION

According to the invention an explosives booster intended for igniting a main explosive charge is provided which includes a first explosive charge which is sensitive enough to be ignited by the explosion of a charge of a detonator charge; and a second explosive charge which is less sensitive to ignition than the first charge, but more sensitive to ignition then the main charge.

With such an arrangement the detonator in use will ignite the said first charge, which in turn will ignite the said second charge, which in turn will ignite the said main charge.

It will be appreciated that with such an arrangement the said first charge may comprise a conventional 60/40 PETN/TNT pentolite mixture, while the said second charge may comprise a pentolite mixture with a lower concentration of PETN, such as, for example, a 40/60 mixture, which accordingly makes it less expensive.

Furthermore, because the only purpose of the said first charge is to ignite the said second charge, a relatively small first charge can be employed which further serves to reduce the costs of the arrangement.

Further according to the invention the booster includes a hollow body which is of substantially ice-cream cone configuration, in longitudinal cross section and which comprises a hollow cup of substantially semi-dome shape and a hollow elongated stem which projects radially outwardly from the apex of the dome; the stem being adapted to carry the detonator and said first charge in its bore, and the cup being adapted to carry said second charge.

Further according to the invention the said bore of the stem of the booster is of circular configuration in cross section, and its diameter where it is ignited by the detonator is at least twice that of the detonator.

Thus, for example, if a conventional type of detonator with a diameter of 7 mm is employed, the effective diameter of the bore of the stem at the ignition point is in the order of at least 14 mm.

Still further according to the invention the said cup is also of circular configuration in cross section, and its diameter at its widest part is at least four times that of the detonator.

Still further according to the invention the diameter of the cup at its widest part is not greater than the total height of the booster measured from the free end of the said stem to said widest part of the cup.

Applicant has found a booster of the aforesaid configuration to have the following advantages:

1. because the detonator is located in a position spaced from, but centrally relative to, the said second charge, optimum use is made of the directional detonation wave caused by the detonator explosion, while an advantageous pressure duration is also obtained;
2. the shape of the booster ensures that a planar shock wave is obtained;
3. the presence of dead zones in the charge behind the point of innitiation of the explosion is avoided, or at least minimised;
4. because of the aforesaid interrelated dimensions of the booster components, a full detonation wave, as well as proper reversed detonation (retonation), is obtained which, because of the gradual build up until the shock wave has fully formed and flattened out, ensures better and prolonged results.

Still further according to the invention the stem of the booster is releasably securable to the cup of the booster, so that differently sized cups may be employed with the same stem in order to provide boosters of, say, 200 g, 400 g and 800 g.

The cup and the stem may each be provided with said second and first charges respectively in any suitable manner such as, for example, by means of a casting operation.

Preferably, also, an inwardly extending detonator well may be provided towards the one side of the said second charge through which the detonator may be passed in order to allow it to be loaded from below into the bore of the stem of the booster while the latter is in position in the blasting hole.

Because of its particular location, such a well has no influence on the shockwave being formed by the explosion. Preferably, the hollow body of the booster is made of a suitable material such as cardboard or plastic.

BRIEF DESCRIPTION OF THE DRAWING

The invention will now be described further by way of example with reference to the drawing, which is a diagrammatic side view of one embodiment of an explosives booster according to the invention.

DESCRIPTION OF AN EMBODIMENT OF THE INVENTION

In this embodiment of the invention an explosives booster 10, which may be of any suitable material such as card board or plastics, has an elongated body comprising a semi-dome shaped hollow cup 11, which is of circular configuration in cross section, and an elongated hollow stem 12, which is also of circular configuration in cross section, and of which the one end can releasably be clipped onto the apexed end of cup 11. The assembled booster 10 is accordingly of substantially ice-cream cone configuration in longitudinal cross section.

Stem 12, which is open at its other or bottom end, i.e. the end opposite the one being clipped on to cup 11, is adapted to hold a conventional type of detonator 13, which may be inserted from below through said open end into the bore of stem 12.

The upper end of the bore of stem 12 flares outwardly in the upward direction to define a compartment 14 into which a first explosive charge 15 comprising a 60/40 PETN/TNT pentolite mixture may be received.

Cup 11 is filled with a second explosive charge 16 comprising a 40/60 PETN/TNT pentolite mixture.

Charge 16 is provided towards its one side with a detonator well 17 through which detonator 13 may be passed in order for it to be located from below into the bore of stem 12 through its said bottom end.

The diameter of compartment 14 at point 18, ("the ignition point") which is in line with the upper end of detonator 13, is approximately twice the size of the diameter of detonator 13, while the diameter of cup 11 at its widest part 19 is more than four times the diameter of detonator 13.

The diameter of cup 11 at its widest part 19 is less than the overall height of booster 10, measured from point 19 to said bottom open end of stem 12.

In use, a cup 11 loaded by means of a casting operation with an explosive charge 16, comprising a 40/60 PETN/TNT pentolite mixture, is clipped onto stem 12, which is loaded by means of a casting operation with an explosive charge 15 comprising a 60/40 PETN/TNT pentolite mixture, and the assembled booster 10 lowered into the blasting hole (not shown).

When booster 10 is in position in said blasting hole (not shown), detonator 13 is passed from above through well 17 in charge 16 and then through said open bottom end of stem 13 until its upper end is imbedded in charge 15, as shown in the drawing.

The said blasting hole (not shown) is then in conventional manner loaded with the main explosive charge (not shown).

When detonator 13 is ignited, it ignites explosive charge 15, which in turn ignites explosive charge 16, which in turn ignites the said main charge (not shown).

Because of the lower concentration of PETN in charge 16, and the relatively small mass of charge 15 compared to that of charge 16, booster 10 is less expensive than the conventional arrangements of comparable size.

Furthermore, because of said dimensional interrelationship between its various components, the use of booster 10 yields all the various advantages referred to above compared to the conventional arrangements.

As will be appreciated, there are no doubt many variations in detail possible with an explosives booster according to the invention without departing from the spirit and/or scope of the claims.

What is claimed is:

1. An explosives booster for igniting a main explosive charge, the booster including a first explosive charge that is sensitive to ignition by a detonator, and a second explosive charge that is less sensitive to ignition than the first charge, but more sensitive to ignition than the main charge, the booster further including a hollow body of generally conical configuration in longitudinal cross section, and comprising a hollow cup for receiving the second charge, and a hollow elongate stem projecting radially outwardly from the apex of the cup and having a bore for receiving the detonator, wherein the end of the bore of the stem closest to the apex of the cup flares outwardly in the direction of the cup to define a compartment for receiving the first explosive charge.

2. The booster of claim 1, wherein the said bore of the stem of the booster is of circular configuration in cross section, and having a diameter, where the first explosive charge is ignited by the detonator, of at least twice that of the detonator.

3. The booster of any one of claims 1 or 2 for receiving a detonator with a diameter of 7 mm, the effective diameter of the bore of the stem at the ignition point being in the order of at least 14 mm.

4. The booster of any one of claims 1 or 2 wherein the cup is of circular configuration in cross section, and having a diameter at its widest part of at least four times that of the detonator.

5. The booster of any one of claims 1 or 2, wherein the diameter of the cup at its widest part is not greater than the total height of the booster measured from the free end of the stem to the widest end of the cup.

6. The booster of any one of claims 1 or 2 wherein the stem of the booster is releasably securable to the cup of the booster, so that differently sized cups may be employed with the same stem in order to provide boosters of respectively 200 g, 400 g and 800 g.

7. The booster of any one of claims 1 or 2 wherein the cup and the compartment of the stem are each provided with said second and first charges respectively by a casting operation.

8. The booster of any one of claims 1 or 2, wherein an inwardly extending detonator well is provided towards the one side of the said second charge through which the detonator may be passed in order to allow it to be loaded from below into the bore of the stem of the booster while the latter is in position in a blasting hole.

9. The booster of any one of claims 1 or 2 wherein the hollow cup is substantially semi-dome shaped.

* * * * *